US008616389B2

(12) United States Patent
Peckham

(10) Patent No.: US 8,616,389 B2
(45) Date of Patent: Dec. 31, 2013

(54) OVER-CENTER SPRING COUPLER

(75) Inventor: Jason D. Peckham, Taylors, SC (US)

(73) Assignee: Wabtec Holding Corp., Wilmerding, PA (US)

( * ) Notice: Subject to any disclaimer, the term of this patent is extended or adjusted under 35 U.S.C. 154(b) by 43 days.

(21) Appl. No.: 13/468,057

(22) Filed: May 10, 2012

(65) Prior Publication Data

US 2013/0299441 A1 Nov. 14, 2013

(51) Int. Cl.
*B61G 3/00* (2006.01)

(52) U.S. Cl.
USPC ..... 213/77; 213/75 R

(58) Field of Classification Search
USPC ..... 213/75 R, 77, 78, 79, 80, 81, 100 R, 116, 213/117, 131, 132, 149, 150
See application file for complete search history.

(56) References Cited

U.S. PATENT DOCUMENTS

| | | | | | |
|---|---|---|---|---|---|
| 325,923 | A | | 9/1885 | Ferguson | |
| 346,881 | A | * | 8/1886 | Zeigler | 213/77 |
| 472,328 | A | | 4/1892 | Baylor | |
| 1,344,780 | A | * | 6/1920 | Van Dorn | 213/77 |
| 1,468,057 | A | * | 9/1923 | Walker | 162/199 |
| 2,150,330 | A | * | 3/1939 | Kurtossy | 213/77 |
| 2,161,724 | A | * | 6/1939 | Scharfenberg | 213/77 |
| 2,183,990 | A | * | 12/1939 | Dunn | 280/506 |
| 2,246,406 | A | * | 6/1941 | Wittmer | 213/104 |
| 2,825,473 | A | * | 3/1958 | Metzger | 213/77 |
| 2,897,982 | A | * | 8/1959 | Larsson | 213/1.6 |
| 3,211,298 | A | * | 10/1965 | Wilson et al. | 213/100 W |
| 3,655,066 | A | * | 4/1972 | Metzger | 213/100 W |
| 4,627,545 | A | * | 12/1986 | Herbert et al. | 213/100 R |
| 4,927,035 | A | * | 5/1990 | Geng et al. | 213/77 |
| 5,344,542 | A | | 9/1994 | Maher et al. | |
| 5,503,280 | A | * | 4/1996 | Hanano et al. | 213/77 |
| 5,509,548 | A | * | 4/1996 | Kreher | 213/77 |
| 5,954,211 | A | * | 9/1999 | Grau et al. | 213/105 |
| 6,390,314 | B1 | * | 5/2002 | Pinlam et al. | 213/75 R |
| 7,467,724 | B2 | * | 12/2008 | Voong et al. | 213/75 R |
| 2005/0145591 | A1 | * | 7/2005 | Mattschull et al. | 213/75 R |

* cited by examiner

*Primary Examiner* — Jason C Smith
(74) *Attorney, Agent, or Firm* — The Webb Law Firm

(57) ABSTRACT

A mating cam coupler device includes a coupler head having a first lateral portion and a second lateral portion. A male cam is associated with the first lateral portion. A male cam locking mechanism is disposed within the first lateral portion and is operably connected with the male cam. A female cam is associated with the second lateral portion. A female cam locking mechanism is disposed within the second lateral portion and is operably connected with the female cam. The male cam is positioned to engage the female cam of an opposing coupler and the female cam is positioned to engage the male cam of the opposing coupler and operation of the male cam locking mechanism is triggered by engagement of the male cam with the opposing female cam and operation of the female cam locking mechanism is triggered by engagement of the female cam with the opposing male cam.

25 Claims, 10 Drawing Sheets

OVER-CENTER SPRING COUPLER

BACKGROUND OF THE INVENTION

1. Field of the Invention

The present invention relates to the field or couplers for railway vehicles and, more particularly, a railway coupler having mating cams to secure a coupled engagement between railway vehicles.

2. Description of Related Art

Railway vehicle couplers are used to securely couple adjacent railway vehicles. In a typical application, a coupler on one railway vehicle is aligned with a corresponding coupler on an adjacent railway vehicle. The two couplers interact to form a releasable connection between the adjacent railway cars. Each railway car desirably has a coupler provided at its longitudinal ends such that a plurality of railway cars may be coupled to form a train.

Within the prior art, conventional railway vehicle couplers may be operated via a chain or cable that utilizes a holding spring to act upon a toe of the coupling device. The holding spring is used to prevent unintended disengagement of the coupling device but also maintains the coupling device in a de-coupled orientation. Such a device is described in U.S. Pat. No. 325,923 to Ferguson.

In another design, U.S. Pat. No. 2,183,990 to Dunn discloses a coupling apparatus in which an over-center spring is used in association with a handle arm that is used to operate an eye element. In the coupled position of the coupler, springs pull on the handle arm and press the upper end of a pressure member rearwardly against the eye element to press the eye element against a hook to hold the eye element in engagement with the hook. In another prior art embodiment, U.S. Pat. No. 6,390,314 to Pinlam et al. discloses a trolley car clamp lock in which a locking engagement between a locking bar and a locking cantilever is secured by a locking bar spring and a locking cantilever spring.

Existing designs for railway vehicle couplers are associated with a number of disadvantages. Conventional railway vehicle couplers typically require precise alignment of railway vehicles to create a secure connection. Horizontal and vertical gathering angles of conventional railway vehicle couplers are relatively small, often allowing only a few degrees of vertical or horizontal misalignment. Additionally, existing railway vehicle couplers are not sufficiently robust to withstand repeated collisions between the couplers during coupling and uncoupling of railway vehicles.

SUMMARY OF THE INVENTION

Accordingly, in view of the foregoing, a railway coupler that allows for increased gathering range within a compact and robust unit is desired. An embodiment of a mating cam coupler for railway vehicles may include a coupler head comprising a first lateral portion and a second lateral portion, wherein the first lateral portion may include a male cam and a male cam locking mechanism disposed within a cavity defined in the first lateral portion and operably connected with the male cam. Similarly, the second lateral portion may include a male cam and a female cam locking mechanism disposed within a cavity defined in the second lateral portion and operably connected with the female cam. The male cam may be positioned to engage a female cam of an opposing coupler device and the female cam nay be positioned to engage a male cam of the opposing coupler device. Operation of the male cam locking mechanism may be triggered by the engagement of the male cam with the opposing female cam and operation of the female cam locking mechanism may be triggered by the engagement of the female cam with the opposing male cam to secure engagement of the coupler device with the opposing coupler device.

In another embodiment, the male cam may be seated in an opening in the first lateral portion, and the female cam may be seated in an opening in the second lateral portion. The male cam may project upward from the first lateral portion and the female cam may project downward from the second lateral portion of the coupler head. The male cam locking mechanism and the female cam locking mechanism may include over-center spring mechanisms.

The coupler head may include a proximal coupling connection for supporting the coupler device relative to a railway vehicle. The first lateral portion and the second lateral portion may be vertically and horizontally offset from one another. The first lateral portion and the second lateral portion may define lead-in inclined surfaces to facilitate coupling with and opposing coupler head. The lead-in inclined surfaces may include vertical and horizontal lead-in inclined surfaces.

In accordance with another embodiment, a mating cam coupler device for railway vehicles may include a coupler head comprising a first lateral portion and a second lateral portion, wherein the first lateral portion has a male cam and a male cam locking mechanism disposed within a cavity defined in the first lateral portion and operably connected with the male cam. Similarly, the second lateral portion may include a male cam and a female cam locking mechanism disposed within a cavity defined in the second lateral portion and operably connected with the female cam. The male cam may be positioned to engage a female cam of an opposing coupler device and the female cam may be positioned to engage a male cam of the opposing coupler device. Operation of the male cam locking mechanism may be triggered by the engagement of the male cam with the opposing female cam and operation of the female cam locking mechanism may be triggered by the engagement of the female cam with the opposing male cam to secure engagement of the coupler device with the opposing coupler device. The mating cam coupler device for railway vehicles may further include an uncoupling mechanism operably connected with the male cam and the female cam to effect disengagement of the male cam from the opposing female cam and disengagement of the female cam from the opposing male cam and release engagement of the coupler with the opposing coupler.

The male cam may be seated in an opening in the first lateral portion and the female cam may be seated in an opening in the second lateral portion. The male cam may project upward from the first lateral portion and the female cam may project downward from the second lateral portion of the coupler head. The male cam locking mechanism and the female cam locking mechanism may include over-center spring mechanisms.

The coupler head may include a proximal coupling connection for supporting the coupler device relative to a railway vehicle. The male cam locking mechanism and the female cam locking mechanism may include over-center spring mechanisms. The first lateral portion and the second lateral portion may be vertically and horizontally offset from one another. The first lateral portion and the second lateral portion may define lead-in inclined surfaces to facilitate coupling with and opposing coupler head. The lead-in inclined surfaces may include vertical and horizontal lead-in inclined surfaces. The uncoupling mechanism may include a release piston connected to the male cam and the female cam by respective links. The uncoupling mechanism may further include a return spring to return the uncoupling mechanism to an initial state after actuation.

In accordance with yet another embodiment, a mating cam coupler device for railway vehicles may include a coupler head comprising a first lateral portion and a second lateral portion, wherein the first lateral portion may include a male cam and a male cam locking mechanism disposed within a cavity defined in the first lateral portion and operably connected with the male cam. Similarly, the second lateral portion may include a male cam and a female cam locking mechanism disposed within a cavity defined in the second lateral portion and operably connected with the female cam. The male and female cam locking mechanisms may include an over-center spring mechanism for locking and unlocking the male and female cam locking mechanisms, respectively. The male cam may be positioned to engage a female cam of an opposing coupler device and the female cam nay be positioned to engage a male cam of the opposing coupler device. Operation of the male cam locking mechanism may be triggered by the engagement of the male cam with the opposing female cam and operation of the female cam locking mechanism may be triggered by the engagement of the female cam with the opposing male cam to secure engagement of the coupler device with the opposing coupler device.

Each over-center spring mechanism of the male and female cam locking mechanisms may include a spring arm having a first end fixed to each of the male and female cams and a second free end and a guide spring rod having a first end pivotally connected to the second free end of the spring arm and a second end having a spring washer slidably mounted thereto. A spring may be provided on the guide spring rod between the first end of the guide spring rod and the spring washer. A spring bracket may engage the spring washer. The spring bracket may have a first side and a second side separated by a cam lobe. In a first position, the spring washer may engage the first side of the spring bracket such that the spring is maintained in a first state. Conversely, in a second position, the spring guide may slide over the cam lobe to engage the second side of the spring bracket such that the spring is maintained in a second state. When the spring is maintained in the first state, the male and female cam locking mechanisms are maintained in a locked state. On the other hand, when the spring is maintained in the second state, the male and female cam locking mechanisms are maintained in an unlocked state.

These and other features and characteristics of the coupler, as well as, the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
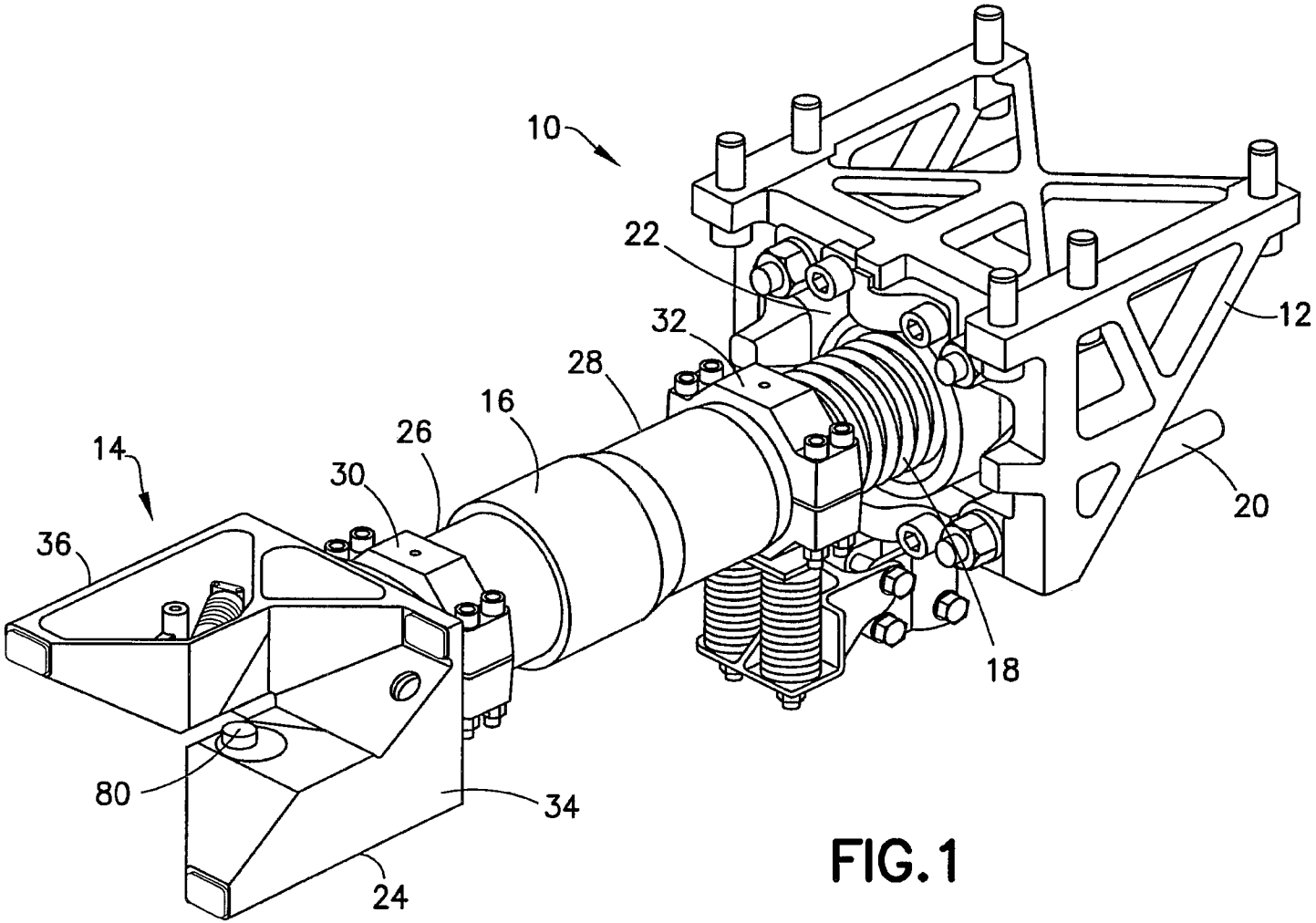
FIG. 1 is a perspective view of an embodiment of a mating cam coupler for railway vehicles.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Referring initially to FIG. 1, an embodiment of an energy absorbing coupling device 10 is shown. The energy absorbing coupling device 10 (hereinafter "coupling device 10"), as described in detail herein, is intended for connection to a car frame (not shown) of a railway vehicle (not shown), as will be readily apparent to those skilled in the railway vehicle art. The coupling device 10 is desirable for use in passenger mass transit vehicles and like railway vehicles. Alternatively, the coupling device 10 may be adapted for use in cargo railway vehicles. However, these specific uses are exemplary only and are not intended to be limiting, and the coupling device 10 has applications in railway vehicles generally.

The coupling device 10 in the depicted embodiment generally includes a coupler anchor 12, a coupler mechanism 14, an energy-absorbing deformation tube 16, and an energy absorbing draft gear mechanism 18. The deformation tube 16 connects the coupler mechanism 14 to the coupler anchor 12 by connection to the draft gear mechanism 18. The coupling device 10 further includes one or more energy absorbing devices 20 for supporting the coupler anchor 12 to the frame of a railway vehicle and, further, for mounting the draft gear mechanism 18 to the coupler anchor 12 through use of a supporting slide anchor assembly 22. Thus, the respective energy absorbing devices 20 interface with the slide anchor assembly 22 to secure the draft gear mechanism 18 to the coupler anchor 12 and are also used to mount the coupler anchor 12 to the frame of a railway vehicle. Certain details of the coupling device 10 are found in U.S. patent application Ser. No. 13/362,045, filed on Jan. 31, 2012, and incorporated herein by reference.

With continuing reference to FIG. 1, the coupler mechanism 14 includes a coupler head 24 for mating the coupler head 24 with a receiving or opposing coupler head 24 on an adjacent or opposing transit car or other rail car. The coupler mechanism 14 is connected to the coupler anchor 12 by the energy absorbing deformation tube 16, as indicated previously. The deformation tube 16 has a distal end 26 opposite a proximal end 28. The distal end 26 of the deformation tube 16 is secured to the coupler head 24 of the coupler mechanism 14 by a first coupling connector 30. The proximal end 28 of the deformation tube 16 is secured to the draft gear mechanism 18 by a second coupling connector 32.

Figure 2:
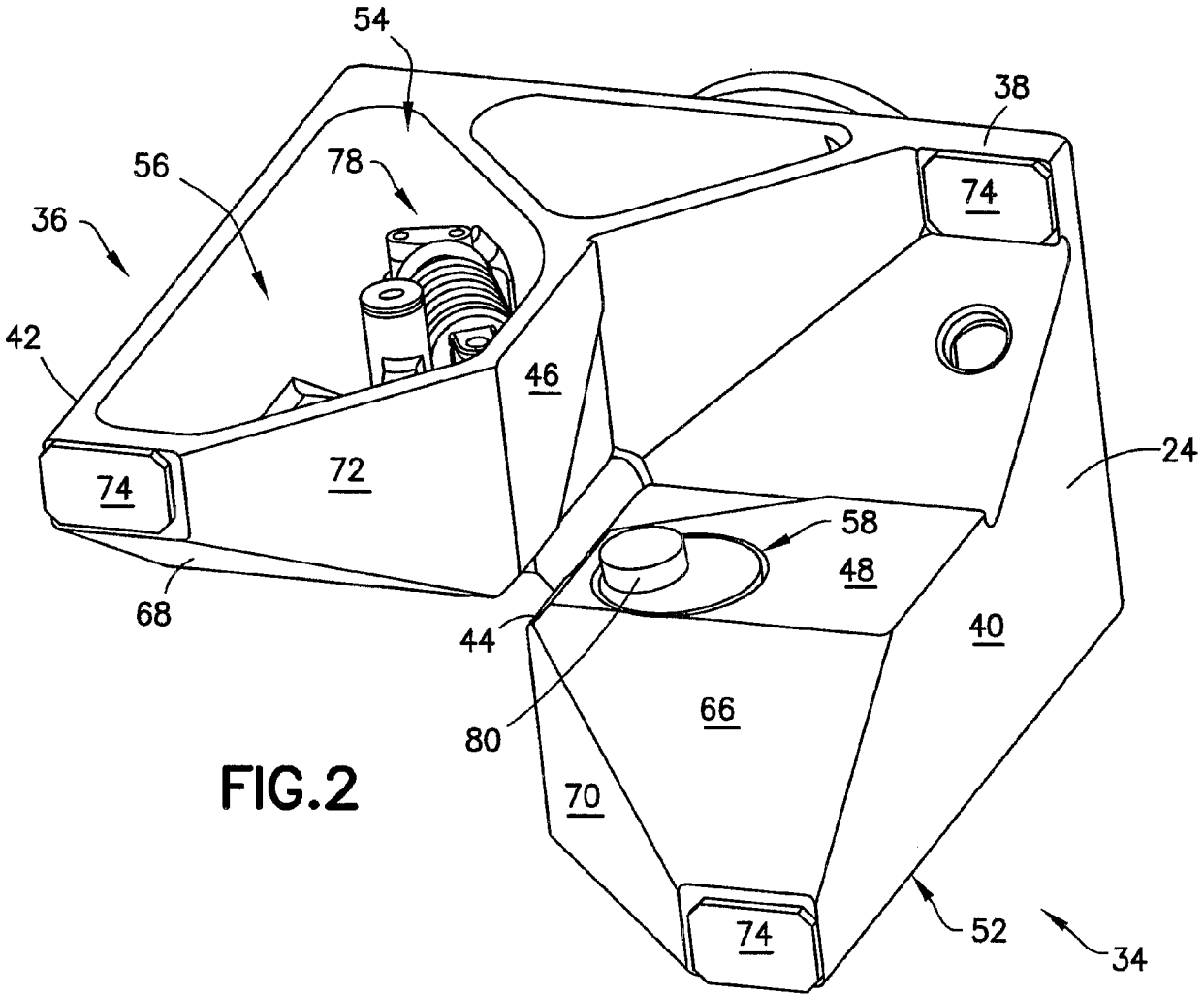
FIG. 2 is a top perspective view of a coupler head in accordance with one embodiment as shown in FIG. 1.
Figure 3:
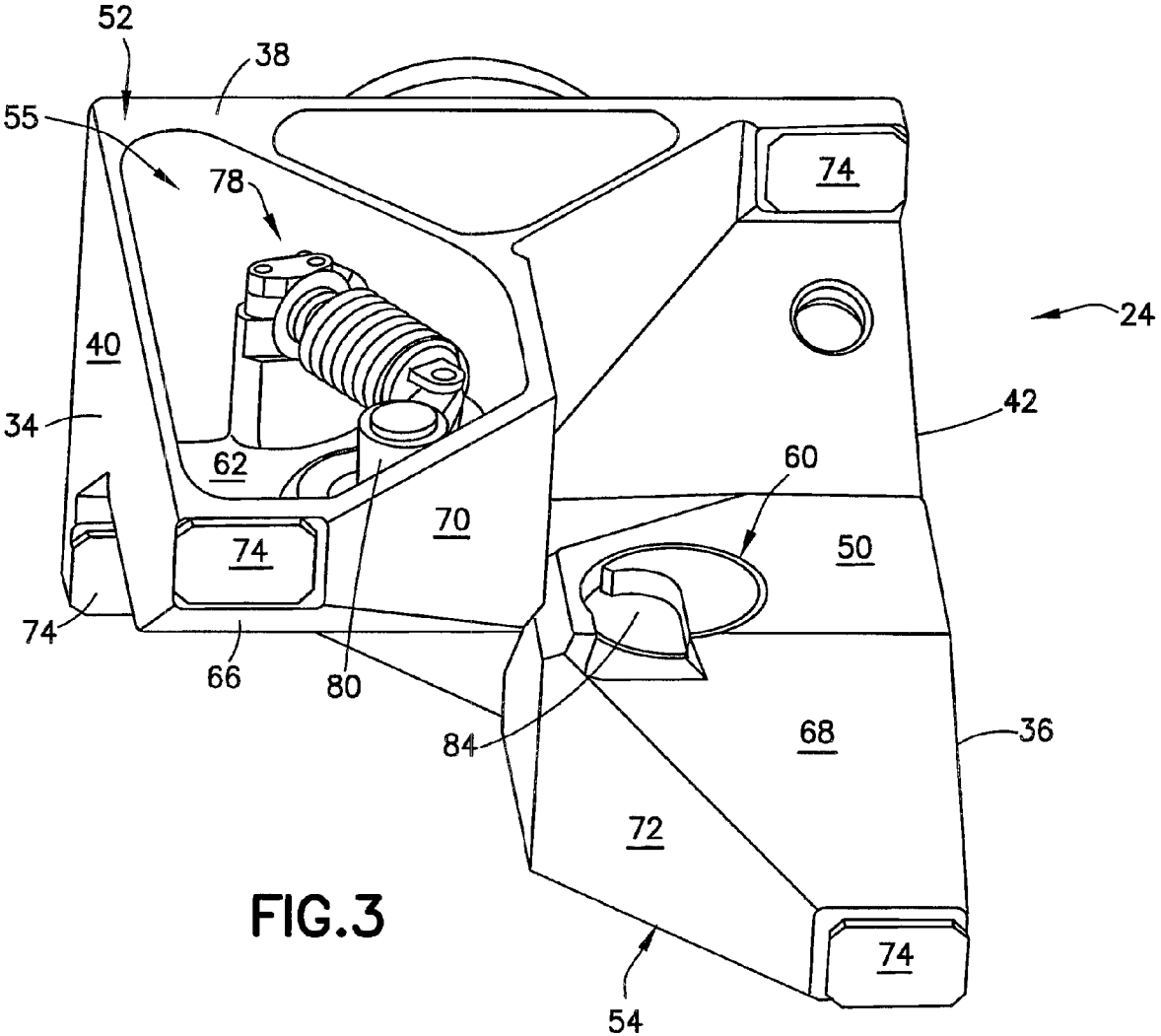
FIG. 3 is a bottom perspective view of the coupler head as shown in FIG. 2.

With reference to FIGS. 2-3, the coupler head 24 of the coupler mechanism 14 is illustrated in greater detail. The coupler head 24 generally has a first lateral portion 34 and a second lateral portion 36 extending from a back plate 38. Each of the first lateral portion 34 and the second lateral portion 36 extends distally from the back plate 38 in a substantially perpendicular direction from a main vertical plane of back plate 38. The first lateral portion 34, the second lateral portion 36, and the back plate 38 may be formed as a single, monolithic structure. In alternative embodiments, the first lateral portion 34 and the second lateral portion 36 may be fixed to the back plate 38 using one or more fasteners, welding, and/or similar coupling means.

Figure 4:
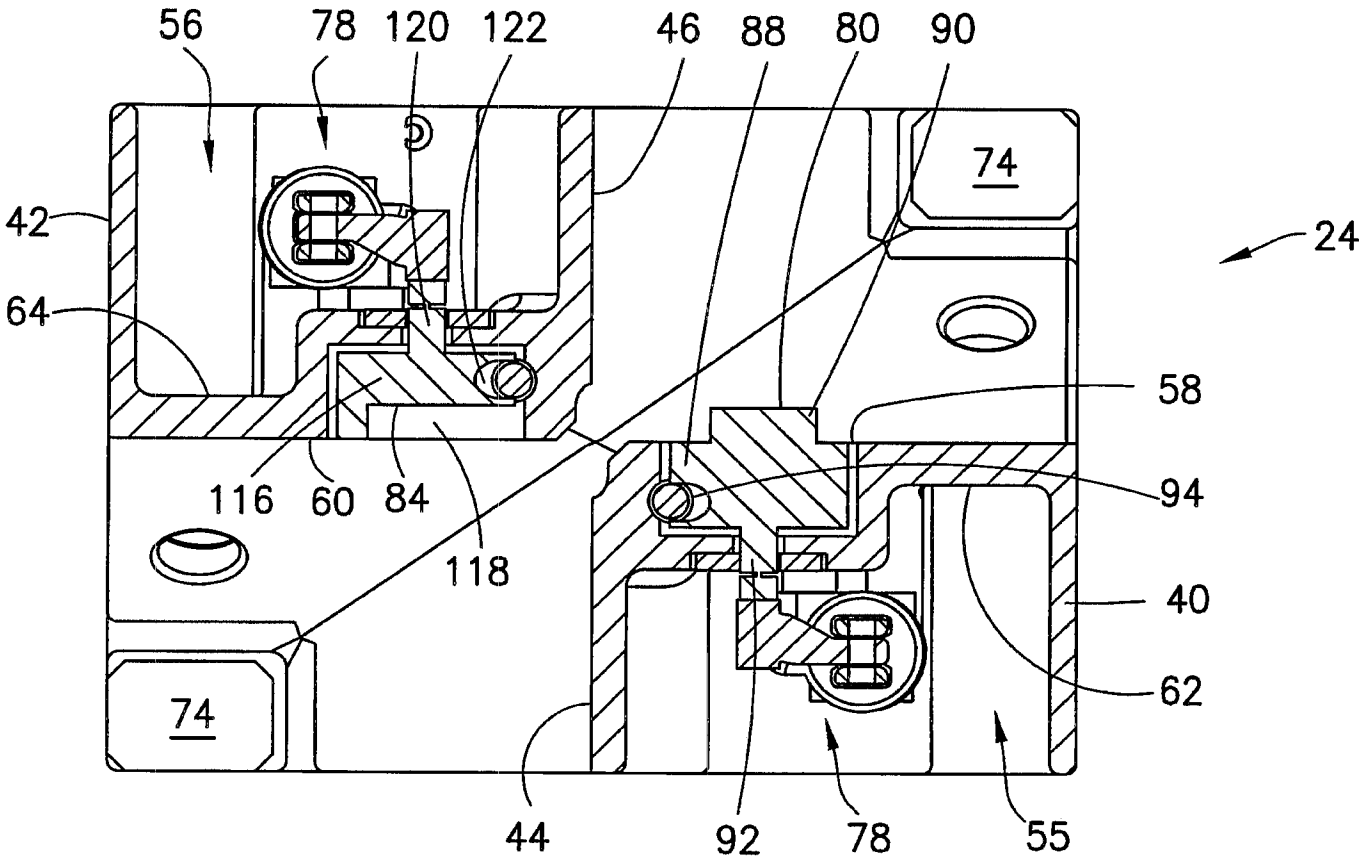
FIG. 4 is a cross-sectional view of the coupler head of FIG. 2 taken along line 4-4 in FIG. 2.

With reference to FIG. 4, the first and second lateral portions 34, 36 are offset from each other in a vertical direction and a lateral direction with respect to back plate 38. In one embodiment, the first and second lateral portions 34, 36 are mirrored about a diagonal line bisecting the main plane of back plate 38 such that the first lateral portion 34 is disposed at a lower vertical position than the second lateral portion 36. The lateral portions 34, 36 are formed to be identical to each other.

The first and second lateral portions 34, 36 have respective outer lateral surfaces 40, 42 opposite respective inner lateral surfaces 44, 46. Additionally, the first and second lateral portions 34, 36 have respective first surfaces 48, 50 and respective second surfaces or faces 52, 54. The first surface 48 of the first lateral portion 34 is provided on an upper facing side of the first lateral portion 34, while the second surface or face 52 of the first lateral portion 34 is provided on a lower facing side of the first lateral portion 34 between the outer lateral surface 40 and the inner lateral surface 44. Similarly, the first surface 50 of the second lateral portion 36 is provided on a lower facing side of the second lateral portion 36, while the second surface or face 54 of the second lateral portion 36 is provided on an upper facing side of the second lateral portion 36 between the outer lateral surface 42 and the inner lateral surface 46.

A cavity 55, 56 is provided in the first and second lateral portion 34, 36, respectively, to accommodate locking mechanisms associated with the first and second lateral portions 34, 36. The cavities 55, 56 are formed in the second faces 52, 54 extend from the second faces 52, 54 toward the first surfaces 48, 50 of the first and second lateral portions 34, 36, respectively. With reference to FIG. 4, a recessed opening 58, 60 extends through a bottom portion 62, 64 of the cavities 55, 56 of the first and second lateral portions 34, 36. The recessed openings 58, 60 are adapted to accommodate respective cams associated with the first and second lateral portions 34, 36.

The first and second lateral portions 34, 36 include a vertical gathering surface 66, 68 and a horizontal gathering surface 70, 72. Each gathering surface 66, 68 and 70, 72 is formed as an inclined lead-in surface to facilitate coupling with an opposing coupler head 24, as will be described in greater detail hereafter. The vertical gathering surfaces 66, 68 extends at an inclined angle or taper away from the respective first surfaces 48, 50 toward second surface 50, 52, respectively, such that an acute angle is created between the first surfaces 48, 50 and the vertical gathering surfaces 66, 68, respectively. Similarly, the horizontal gathering surfaces 70, 72 extend or taper inward from the respective inner lateral surfaces 44, 46 of the first and second lateral portions 34, 36 in an angled direction toward the respective outer lateral surfaces 40, 42 of the first and second lateral portion 34, 36 such that an acute angle is formed between the outer lateral surface 40, 42 and the horizontal gathering surfaces 70, 72 respectively. An angle defined between the opposing vertical gathering surfaces 66, 68 represent a vertical gathering angle indicative of an amount of vertical offset which may be allowed between opposing coupler heads in order for a secure connection to occur. Similarly, an angle defined between the opposing horizontal gathering surfaces 70, 72 represent a horizontal gathering angle indicative of an amount of horizontal offset which may be allowed between opposing coupler heads in order for a secure connection to occur.

Additionally, wear pads 74 may be provided on the front face of the back plate 38 adjacent to the first and second lateral portion 34, 36, as well as on the terminal distal ends of the first and second lateral portion 34, 36. Each wear pad 74 may be constructed from a resilient material, such as hard rubber, and serves to cushion an impact when opposing coupler heads 24 are joined during coupling of railway vehicles. The wear pads 74 may be glued onto the coupler head 24 or secured in a similar manner. The wear pads 74 may also be removably connected to the foregoing location on the coupler head 24 such that they can be replaced when worn out due to repeated collisions between opposing coupler heads 24 during coupling of railway vehicles.

With further reference to FIGS. 7-10, the coupler head 24 includes a proximal coupling connection 76 provided on a rear side or face of the back plate 38. The proximal coupling connection 76 connects the coupler head 24 relative to a railway vehicle (not shown). For example, the proximal coupling connection 76 couples the coupler head 24 to the deformation tube 16 via the first coupling connector 30. One or more openings may be provided in the proximal coupling connection 76 for connection with a pneumatic or hydraulic pressure source or an electrical source for operating the locking mechanism.

Figure 5:
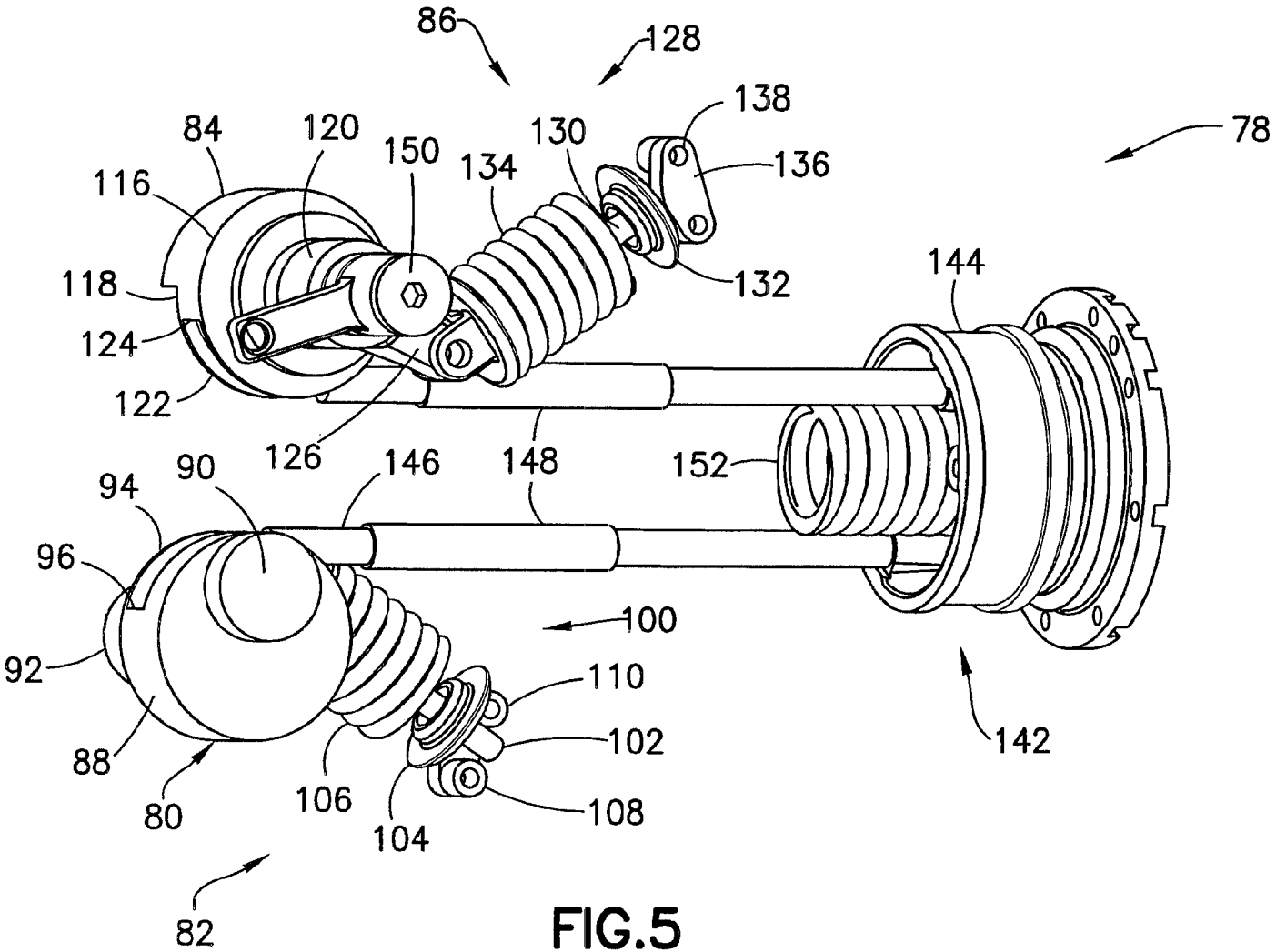
FIG. 5 is an isolation perspective view of cam elements, cam locking mechanisms, and an uncoupling mechanism associated with the coupler head shown in FIG. 2.
Figure 6:
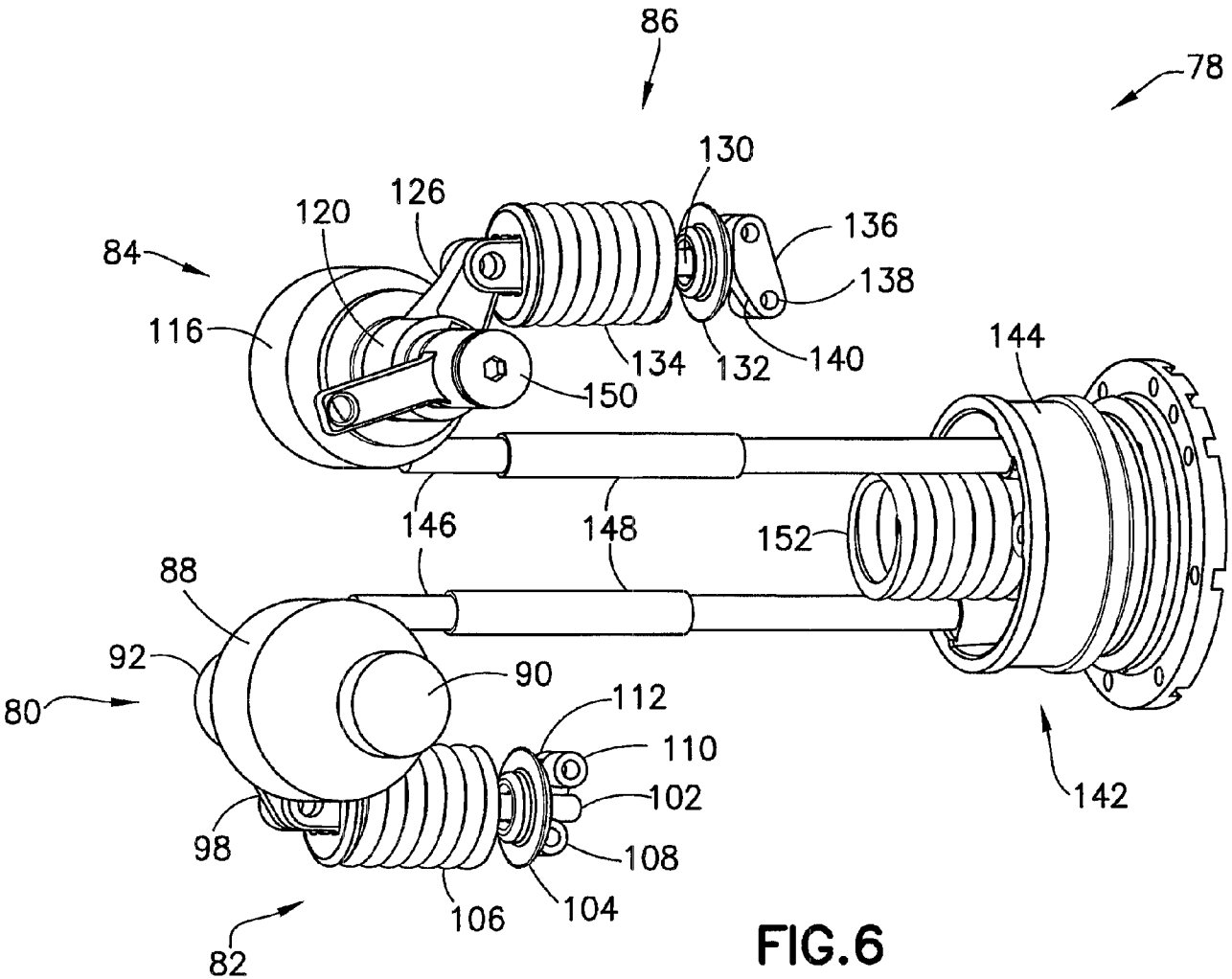
FIG. 6 is an isolation perspective view showing the cam elements, cam locking mechanisms, and an uncoupling mechanism of FIG. 5 shown in an uncoupled state.

With specific reference to FIGS. 5-6, and continued reference to FIGS. 2-4, a coupling assembly 78 is provided in each of the cavities 55, 56 are formed in the second faces 52, 54 of the first and second lateral portion 34, 36, for coupling and uncoupling the coupler mechanisms 14 provided on opposing railway cars. Each coupling assembly 78 includes a male cam 80 operable by a male cam locking mechanism 82 and a female cam 84 operable by a female cam locking mechanism 86. As shown in FIGS. 2-4, the male cam 80 is seated in the recessed opening 58 in the first lateral portion 34 and the male cam locking mechanism 82 is provided within the cavity 55. Similarly, the female cam 84 is seated in the recessed opening 60 in the second lateral portion 36 and the female cam locking mechanism 86 is provided within cavity 56. The male cam 80 projects vertically upward from the first surface 50 of the first lateral portion 34, while the female cam 84 projects vertically downward from the first surface 50 of the second lateral portion 36.

The male cam 80 includes a central portion 88 having a central axis extending though the center of the male cam 80 along the longitudinal length thereof. A cam element 90 is provided on a surface of the central portion 88 offset from the central axis of the central portion 88 about which the male cam 80 rotates. A shaft 92 is coaxial with the central portion 88 and extends from an opposing side of the central portion 88 in a direction away from the cam element 90. The male cam 80 is rotatable about the central axis of the central portion 88 such that rotation causes the cam element 90 to follow a circular path about the central axis of the central portion 88 as the male cam 80 is rotated. The central portion 88 of the male cam 80 includes an arcuate groove 94 extending around a portion of an outer perimeter of the central portion 88. The groove 94 has a stop face 96 which interacts with a pushrod for causing the male cam 80 to rotate, and thereby causes the locking or unlocking of the male cam 80 with a female cam of an adjacent coupler.

The shaft 92 of the male cam 80 includes a spring arm 98 integrally coupled with the shaft 92. The shaft 92 of the male cam 80 couples the male cam 80 to a male cam locking mechanism 100. The male cam locking mechanism 100 includes an over-center spring mechanism for locking and unlocking the male cam 80. Rotation of the shaft 92 about central axis of the central portion 88 of the male cam 80 causes the spring arm 98 to move in an arcuate path corresponding to the angular rotation of shaft 92. A terminal end of the spring arm 98 is coupled to a first end of a guide spring rod 102. In turn, a second end of the guide spring rod 102 interacts with a spring washer 104, which is moveable along the length of the guide spring rod 102. A compression spring 106 is disposed around the guide spring rod 102 between its first and second ends. The spring washer 104 engages a spring bracket 108 which is secured to the bottom portion 62 of cavity 54 by a plurality of fasteners (not shown) engaging through holes 110 extending through the spring bracket 108. The spring bracket 108 has a cam lobe 112 over which spring washer 104 can slide depending on the orientation of the male cam 80. In a first position, such as when opposing coupling assemblies 78 are in an unlocked state, the spring washer 104 is positioned on one side of the cam lobe 112. In a second position, such as when opposing coupling assemblies 78 are in a locked state, the over-center spring structure of male cam locking mechanism 100 causes the spring washer 104 to slide over the cam lobe 112.

Figure 7:
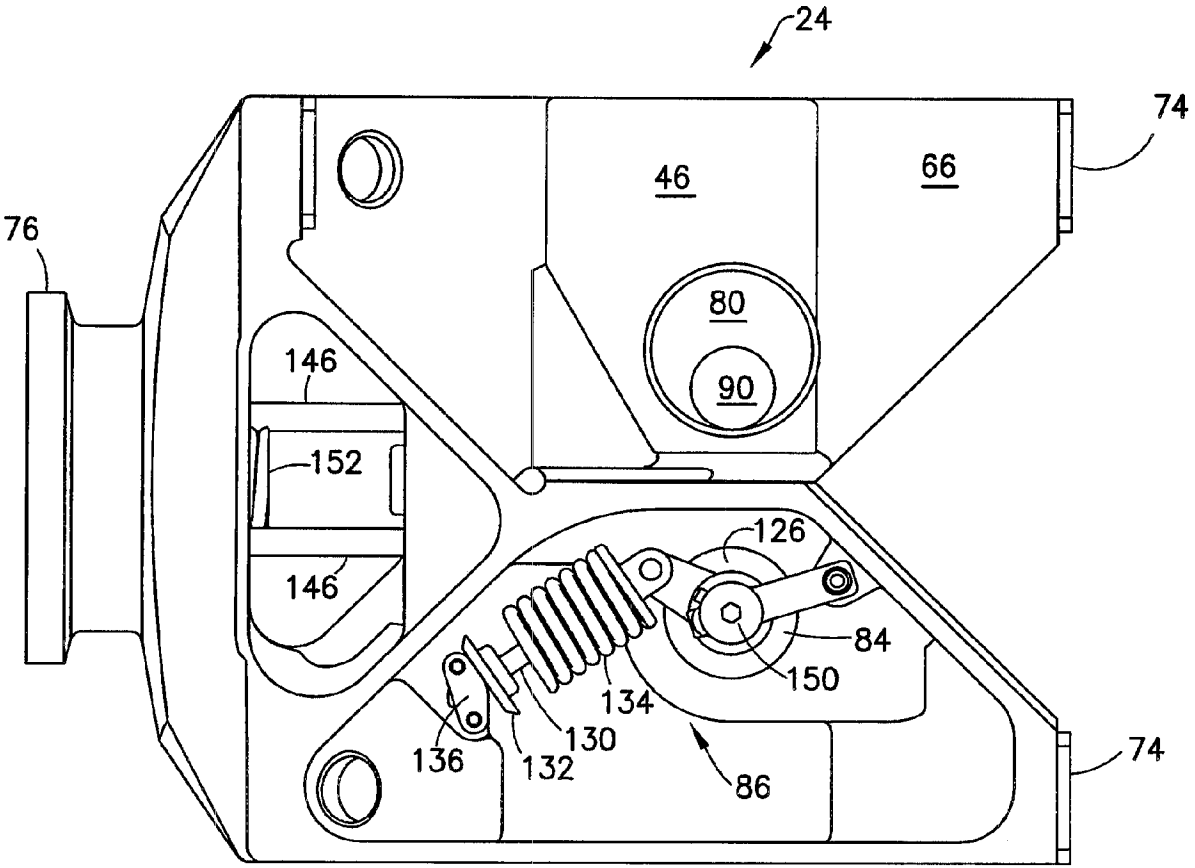
FIG. 7 is a top plan view of the coupler head of FIG. 2 shown in an uncoupled state.
Figure 9:
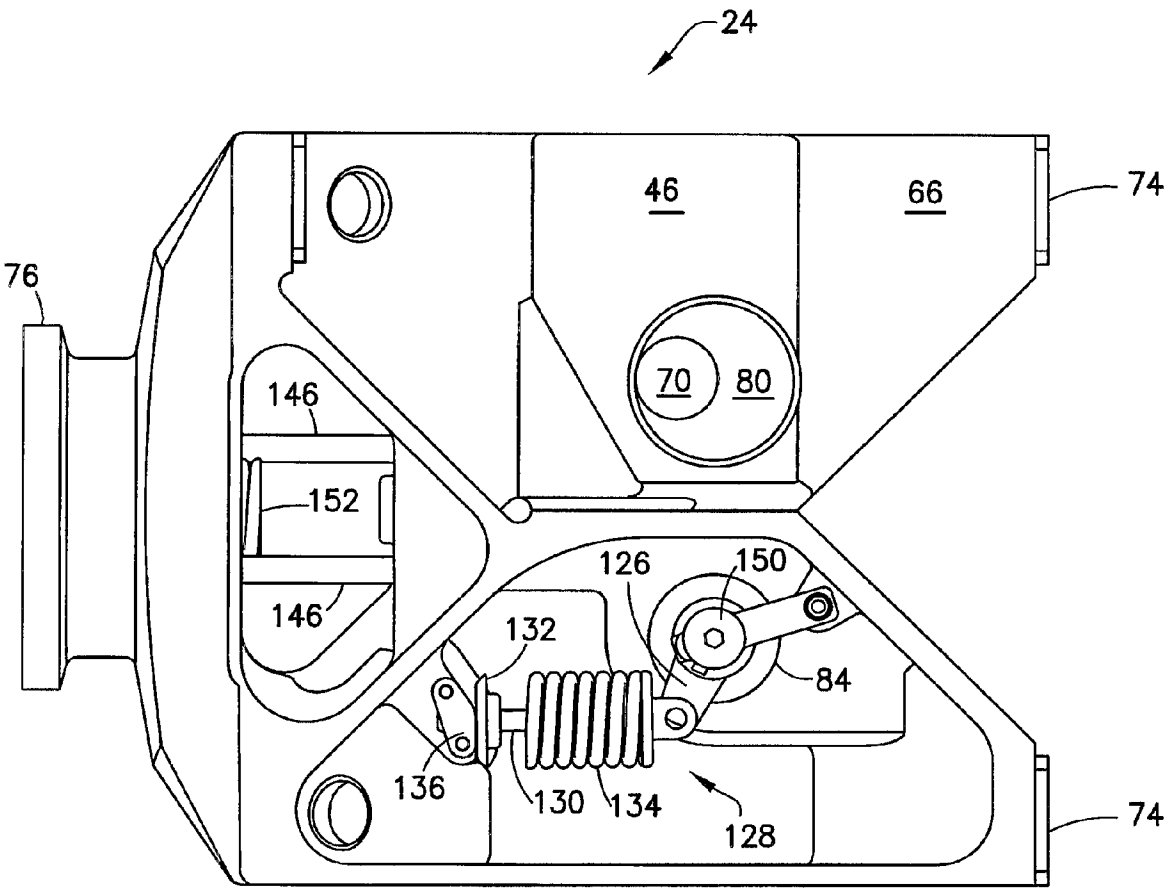
FIG. 9 is a top plan view of the coupler head of FIG. 2 shown in a coupled state.

With reference to FIGS. 7 and 9, and with continuing reference to FIGS. 5-6, the female cam 84 is operated in a similar manner to the male cam 80 to cause the female cam 84 to rotate through a pre-determined angular range for causing the female cam 84 to lock with a corresponding male cam provided on an opposing railway vehicle. The female cam 84 includes a central portion 116 having a central axis extending though the center of the female cam 84 along the longitudinal length thereof. A locking element 118 is provided on a surface of the central portion 116 offset from central axis of the central portion 116 about which the female cam 84 rotates. The locking element 118 has a linear portion provided at a periphery of the locking element 118 and extending radially inward. The locking element 118 also has an arcuate portion that is offset from the central axis of the female cam 84. The arcuate portion of the locking cam 118 can be aligned with cam element 90 such that cam element 90 can be advanced linearly with respect to the locking element 118 until the cam element 90 engages the arcuate portion of the locking element 118. Because the cam element 90 is offset with respect to the central axis of the male cam 80, any further linear movement of the cam element 90 with respect to the locking element 118 will cause a rotation of the male cam 80 and the female cam 84 about their central axes. A shaft 120 is coaxial with the central portion 116 and extends from an opposing surface of the central portion 116 in a direction away from locking element 118. The female cam 84 is rotatable about the central axis of the a central portion 116 such that rotation causes the locking element 118 to follow a circular path about the central axis of the central portion 116 as the female cam 84 is rotated.

As best shown in FIG. 3, the locking element 118 of the female cam 84 is recessed with respect to upper surface of the central portion 116 and is dimensioned to accept a male cam 80 from an opposing coupler. The locking element 118 includes a linear portion and an arcuate portion, wherein linear portion is adapted for allowing an opposing male cam to slide in with respect to the female cam 84, while the arcuate portion causes the female cam 84 to lock the male cam 80 within the arcuate portion and prevent disengagement of the male cam 80 from the female cam 84. The central portion 116 of the female cam 84 includes an arcuate groove 122 extending around a portion of an outer perimeter of the central portion 116. The groove 122 has a stop face 124 which interacts with a pushrod for causing the female cam 84 to rotate, and thereby cause the locking or unlocking of the female cam 84 with a male cam 80 of an adjacent coupler. The shaft 120 of the female cam 84 includes a spring arm 126 integrally coupled with shaft 120. The shaft 120 of the female cam 84 couples a female cam 84 to a female cam locking mechanism 128.

The female cam locking mechanism 128 includes an over-center spring mechanism for locking and unlocking the female cam 84. Rotation of the shaft 120 about the central axis of the a central portion 116 of the female cam 84 causes the spring arm 126 to move in an arcuate path corresponding to the angular rotation of shaft 120. The terminal end of spring arm 126 is coupled to a first end of a guide spring rod 130. In turn, a second end of guide spring rod 130 interacts with a spring washer 132, which is moveable along the length of the guide spring rod 130. A compression spring 134 is disposed around the guide spring rod 130 between its first and second ends. The spring washer 132 engages a spring bracket 136 which is secured to the bottom portion 64 of the cavity 56 by a plurality of fasteners (not shown) engaging through holes 138 extending through the spring bracket 136. The spring bracket 136 has a cam lobe 140 over which the spring washer 132 can slide depending on the orientation of the female cam 84. In a first position, such as when opposing coupling assemblies 78 are in an unlocked state, the spring washer 132 is positioned on one side of the cam lobe 140. In a second position, such as when opposing coupling assemblies 78 are in a locked state, the over-center spring structure of female cam locking mechanism 128 causes the spring washer 132 to slide over the cam lobe 140.

In operation, the coupling device 10 is mated with an adjacent coupling device 10 provided on an opposing railway car by advancing opposing railway cars in a substantially linear manner toward each other. Prior to engagement, the male cam 80 is positioned to engage the female cam 84 of an opposing coupling device 10 and the female cam 84 is positioned to engage the male cam 80 of the opposing coupling device 10. The vertical gathering surfaces 66, 68 and the horizontal gathering surfaces 70, 72 guide the opposing coupling devices 10 for proper alignment such that the first lateral portion 34 of one coupling device 10 is vertically and horizontally aligned with the second lateral portion 36 of an opposing coupling device 10. Similarly, the second lateral portion 36 of one coupling device 10 is vertically and horizontally aligned with the first lateral portion 34 of an opposing coupling device 10.

Figure 10:
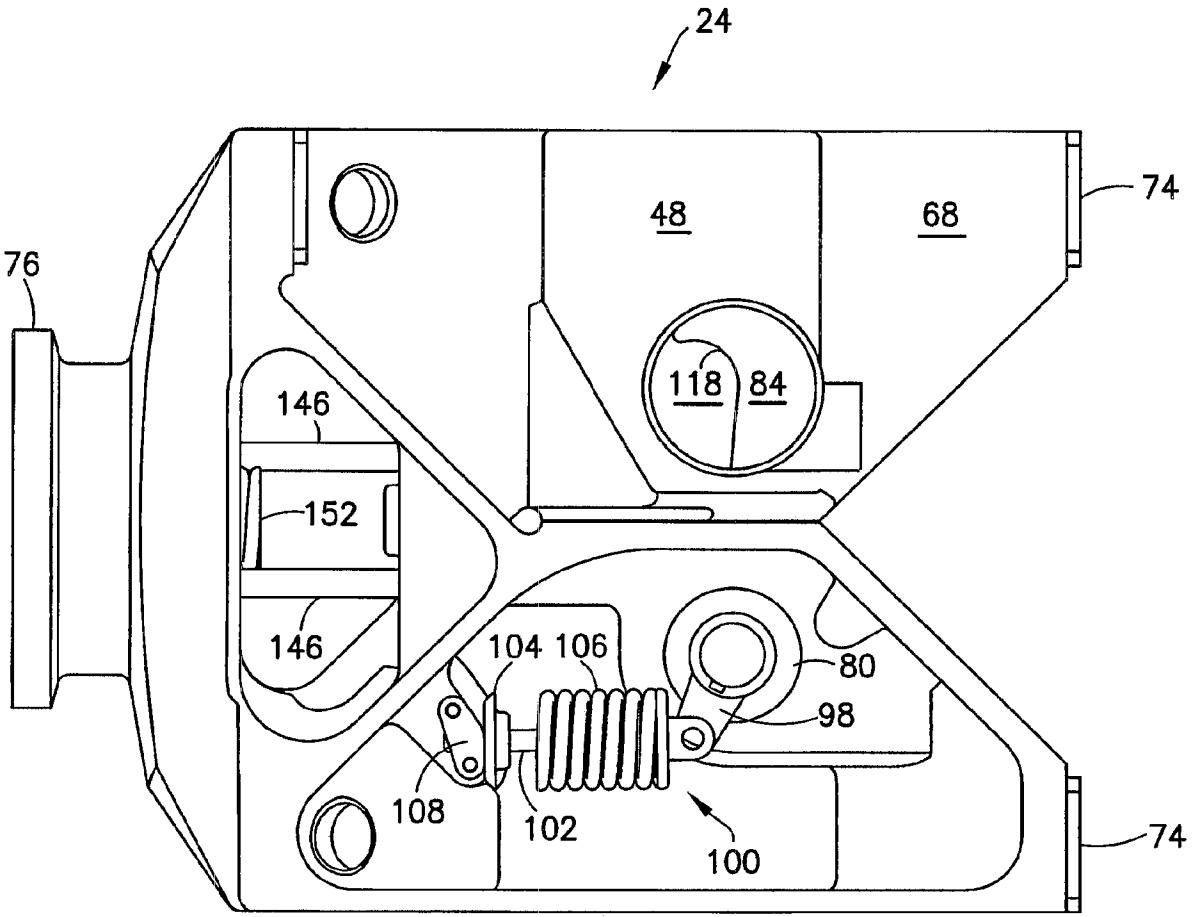
FIG. 10 is a bottom perspective view of the coupler head of FIG. 2 shown in a coupled state.

Operation of the male cam locking mechanism 82 is triggered by the engagement of the male cam 80 with the opposing female cam 84, and operation of the female cam locking mechanism 86 is triggered by the engagement of the female cam 84 with the opposing male cam 80 to secure engagement of coupling device 10 with the opposing coupling device 10. As one coupling device 10 advances in a linear direction toward the opposing coupling device 10, the cam element 90 makes contact with the arcuate surface of the locking element 118. Engagement of the cam element 90 with the locking element 118 by linear advancement of one coupling device 10 toward the opposing coupling device 10 causes the rotation of the male cam 80 and female cam 84 about their central axes. More specifically, once the cam element 90 contacts the locking element 118 by sliding within the opening of the locking element, linear movement of cam element 90 with respect to the locking element 118 is limited to the length of a linear portion of the locking element 118. Once the cam element 90 contacts the arcuate portion of the locking element 118, any further linear movement of the cam element 90 with respect to the locking element 118 will cause a rotation of the male cam 80 and the female cam 84 about their central axes. In turn, rotation of the cams 80, 84 causes the respective spring arms to rotate, thereby pushing the respective guide spring rods 102, 130 and compressing the springs 106, 134 against the spring washers 104, 132, respectively. As the springs 106, 134 are compressed, the spring washers 104, 132 slide over the respective cam lobes 112, 140 provided on the spring brackets 108, 136, causing the over-center spring mechanism construction of the locking mechanisms to move from a first state to a second state. When the spring washers 104, 132 slide over the cam lobes 112, 140, respectively, the male cam 80 and female cam 84 are retained in a locked position, as illustrated in FIGS. 6 and 9-10. Once in a locked position, the linear portion of the locking element 118 of the female cam 84 is rotated to a position to prevent the cam element 90 from sliding out from the locking engagement with the locking element 118.

Disengagement of adjacent coupling devices 10 is operative through an uncoupling mechanism 142. The uncoupling mechanism 142 is operably connected with the male cam 80 and female cam 84 to effect disengagement of the male cam 80 from the opposing female cam 84 and disengagement of the female cam 84 from the opposing male cam 80, and release engagement of one coupling device 10 from the opposing coupling device 10.

Referring back to FIGS. 5-6, the uncoupling mechanism 142 includes a piston 144 operatively connected to a pair of push rods 146. The piston 144 may be a pneumatic or hydraulic piston coupled to a compressed air or hydraulic fluid supply line (not shown) provided on the railway car. Linear movement of the piston 144 causes a corresponding linear movement of push rods 146. At one end, the push rods 146 are coupled to piston 144, while at an opposing end, the push rods 146 are provided adjacent to the male cam 80 and the female cam 84. Because the push rods 146 extend through the coupler head 24, bushings 148 are provided to enable linear movement of the push rods 146 with respect to the coupler head 24. Terminal ends of each push rod 146 are aligned with the male cam 80 and the female cam 84 such that push rods 146 are substantially tangential to the arcuate grooves 94, 122 in the male cam 80 and the female cam 84, respectively. In an unlocked state, such as when railway cars are ready for coupling or uncoupling, the male cam 80 and the female cam 84 are disposed such that the stop faces 96, 124 in the arcuate grooves 94, 122 are rotated away from terminal ends of the push rods 146. In a locked state when adjacent railway cars are coupled together, the male cam 80 and the female cam 84 are rotated such that the stop faces 96, 124 in the arcuate grooves 94, 122 are in contact with the terminal ends of the push rods 146.

Figure 8:
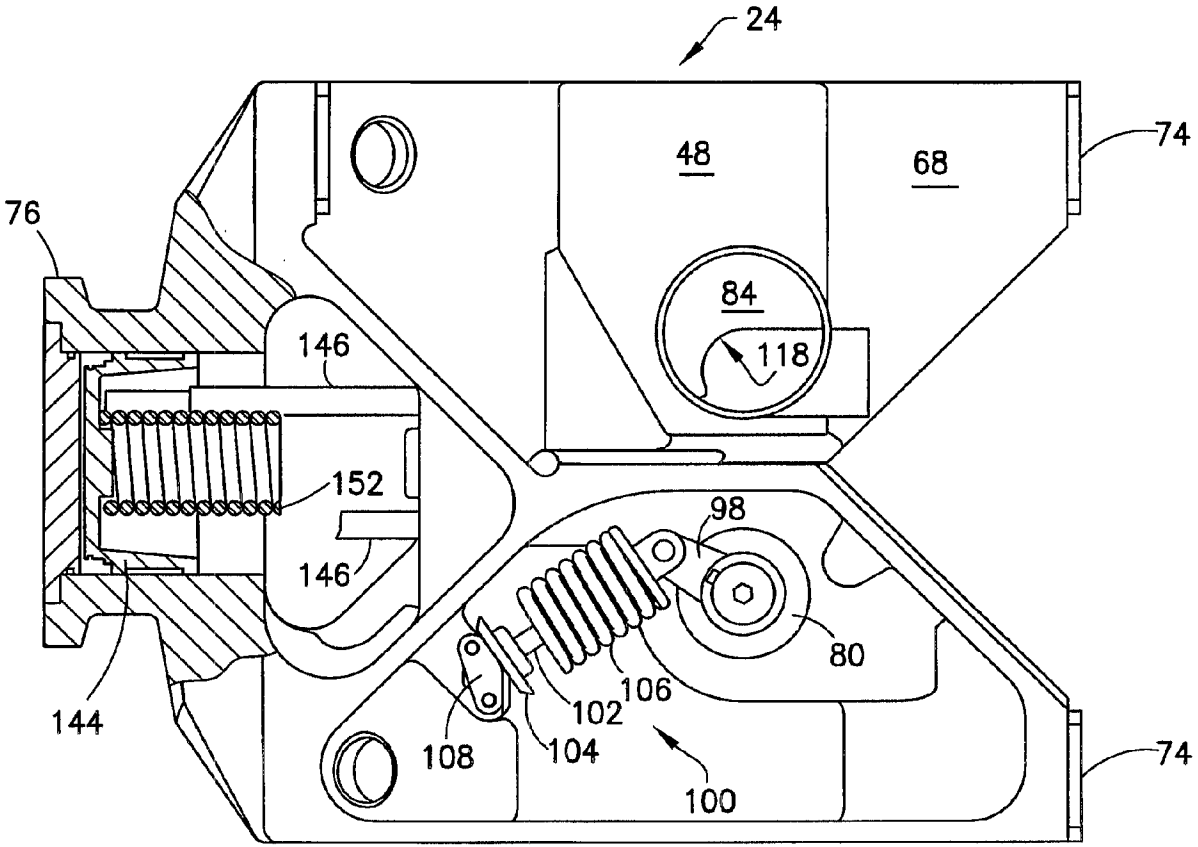
FIG. 8 is a bottom plan view of the coupler head of FIG. 2 shown in an uncoupled state.

In operation, the unlocking mechanism 142 operates by the pressurizing piston 144 such that the push rods 146 are advanced in a linear manner toward the male and female cams 80, 84. Movement of the push rods 146 causes contact with the stop faces 96, 124 in the arcuate grooves 94, 122 and a corresponding rotation of the male and female cams 80, 84. Rotation of the male and female cams 80, 84 causes the spring arms 98, 126 to rotate, thereby pulling the respective guide spring rods 102, 130 and decompressing the springs 106, 134 from the spring washers 104, 132, respectively. As the springs 106, 134 are decompressed, the spring washers 104, 132 slide over the respective cam lobes 112, 140 provided on the spring brackets 108, 136. When the spring washers 104, 132 slide over the cam lobes 112, 140, respectively, the male cam 80 and the female cam 84 are moved to an unlocked position, as illustrated in FIGS. 5 and 7-8. Once in an unlocked position, the linear portion of locking element 118 of the female cam 84 is rotated to a position to allow the cam element 90 of the male cam 80 to slide out from locking engagement with the locking element 118.

The female cam 84 has an exhaust valve 150 operatively connected to the piston 144. The exhaust valve 150 is actuated when the female cam 84 is rotated to an unlocked position to exhaust the pressure from the cylinder within which the piston 144 moves. As the pressure is exhausted, the piston 144 is retracted by way of a return spring 152 to return the uncoupling mechanism 142 to an initial, unlocked state after pneumatic actuation. While the present disclosure describes the exhaust valve 150 being provided on the female cam 84, it will be understand that the exhaust valve 150 can be provided on the male cam 80, or both cams 80, 84 without departing from the scope of the invention.

While embodiments of a coupler mechanism for railway and like vehicles and methods of operation thereof, were provided in the foregoing description, those skilled in the art may make modifications and alterations to these embodiments without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A mating cam coupler device for railway vehicles, comprising:

a coupler head comprising a first lateral portion and a second lateral portion;

wherein the first lateral portion comprises a male cam and a male cam locking mechanism disposed within a cavity defined in the first lateral portion and operably connected with the male cam;

wherein the second lateral portion comprises a female cam and a female cam locking mechanism disposed within a cavity defined in the second lateral portion and operably connected with the female cam; and wherein the male cam is positioned to engage a female cam of an opposing coupler device and the female cam is positioned to engage a male cam of the opposing coupler device and operation of the male cam locking mechanism is triggered by the engagement of the male cam with the opposing female cam and operation of the female cam locking mechanism is triggered by the engagement of the female cam with the opposing male cam to secure engagement of the coupler device with the opposing coupler device.

2. The mating cam coupler device for railway vehicles as claimed in claim 1, wherein the male cam is seated in an opening in the first lateral portion, and wherein the female cam is seated in an opening in the second lateral portion.

3. The mating cam coupler device for railway vehicles as claimed in claim 1, wherein the coupler head comprises a proximal coupling connection for supporting the coupler device relative to a railway vehicle.

4. The mating cam coupler device for railway vehicles as claimed in claim 1, wherein the male cam locking mechanism and the female cam locking mechanism comprise over-center spring mechanisms.

5. The mating cam coupler device for railway vehicles as claimed in claim 1, wherein the first lateral portion and the second lateral portion are vertically offset from one another.

6. The mating cam coupler device for railway vehicles as claimed in claim 1, wherein the first lateral portion and the second lateral portion are horizontally offset from one another.

7. The mating cam coupler device for railway vehicles as claimed in claim 1, wherein the male cam projects upward from the first lateral portion and the female cam projects downward from the second lateral portion of the coupler head.

8. The mating cam coupler device for railway vehicles as claimed in claim 1, wherein the first lateral portion and the second lateral portion define lead-in inclined surfaces to facilitate coupling with and opposing coupler head.

9. The mating cam coupler device for railway vehicles as claimed in claim 8, wherein the lead-in inclined surfaces comprise vertical and horizontal lead-in inclined surfaces.

10. A mating cam coupler device for railway vehicles, comprising:

a coupler head comprising a first lateral portion and a second lateral portion;

wherein the first lateral portion comprises a male cam and a male cam locking mechanism disposed within a cavity defined in the first lateral portion and operably connected with the male cam;

wherein the second lateral portion comprises a female cam and a female cam locking mechanism disposed within a cavity defined in the second lateral portion and operably connected with the female cam; and wherein the male cam is positioned to engage a female cam of an opposing coupler device and the female cam is positioned to engage a male cam of the opposing coupler device and operation of the male cam locking mechanism is triggered by the engagement of the male cam with the opposing female cam and operation of the female cam locking mechanism is triggered by the engagement of the female cam with the opposing male cam to secure engagement of the coupler device with the opposing coupler device; and an uncoupling mechanism operably connected with the male cam and the female cam to effect disengagement of the male cam from the opposing female cam and disengagement of the female cam from the opposing male cam and release engagement of the coupler with the opposing coupler.

11. The mating cam coupler device for railway vehicles as claimed in claim 10, wherein the male cam is seated in an opening in the first lateral portion, and wherein the female cam is seated in an opening in the second lateral portion.

12. The mating cam coupler device for railway vehicles as claimed in claim 10, wherein the coupler head comprises a proximal coupling connection for supporting the coupler device relative to a railway vehicle.

13. The mating cam coupler device for railway vehicles as claimed in claim 10, wherein the male cam locking mechanism and the female cam locking mechanism comprise over-center spring mechanisms.

14. The mating cam coupler device for railway vehicles as claimed in claim 10, wherein the first lateral portion and the second lateral portion are vertically offset from one another.

15. The mating cam coupler device for railway vehicles as claimed in claim 10, wherein the first lateral portion and the second lateral portion are horizontally offset from one another.

16. The mating cam coupler device for railway vehicles as claimed in claim 10, wherein the male cam projects upward from the first lateral portion and the female cam projects downward from the second lateral portion of the coupler head.

17. The mating cam coupler device for railway vehicles as claimed in claim 10, wherein the first lateral portion and the second lateral portion define lead-in inclined surfaces to facilitate coupling with and opposing coupler head.

18. The mating cam coupler device for railway vehicles as claimed in claim 17, wherein the lead-in inclined surfaces comprise vertical and horizontal lead-in inclined surfaces.

19. The mating cam coupler device for railway vehicles as claimed in claim 10, wherein the uncoupling mechanism comprises a release piston connected to the male cam and the female cam by respective links.

20. The mating cam coupler device for railway vehicles as claimed in claim 19, wherein the uncoupling mechanism further comprises a return spring to return the uncoupling mechanism to an initial state after actuation.

21. A mating cam coupler device for railway vehicles, comprising:

a coupler head comprising a first lateral portion and a second lateral portion;

wherein the first lateral portion comprises a male cam and a male cam locking mechanism disposed within a cavity defined in the first lateral portion and operably connected with the male cam;

wherein the second lateral portion comprises a female cam and a female cam locking mechanism disposed within a cavity defined in the second lateral portion and operably connected with the female cam;

wherein the male and female cam locking mechanisms comprise an over-center spring mechanism for locking and unlocking the male and female cam locking mechanisms, respectively; and wherein the male cam is positioned to engage a female cam of an opposing coupler device and the female cam is positioned to engage a male cam of the opposing coupler device and operation of the male cam locking mechanism is triggered by the engagement of the male cam with the opposing female cam and operation of the female cam locking mechanism is triggered by the engagement of the female cam with the opposing male cam to secure engagement of the coupler device with the opposing coupler device.

22. The mating cam coupler device for railway vehicles as claimed in claim 21, wherein each over-center spring mechanism of the male and female cam locking mechanisms comprises:

a spring arm having a first end fixed to each of the male and female cams and a second free end;

a guide spring rod having a first end pivotally connected to the second free end of the spring arm and a second end having a spring washer slidably mounted thereto;

a spring provided on the guide spring rod between the first end of the guide spring rod and the spring washer; and a spring bracket engaging the spring washer.

23. The mating cam coupler device for railway vehicles as claimed in claim 22, wherein the spring bracket further comprises a first side and a second side separated by a cam lobe.

24. The mating cam coupler device for railway vehicles as claimed in claim 23, wherein, in a first position, the spring washer engages the first side of the spring bracket such that the spring is maintained in a first state and wherein, in a second position, the spring guide slides over the cam lobe to engage the second side of the spring bracket such that the spring is maintained in a second state.

25. The mating cam coupler device for railway vehicles as claimed in claim 23, wherein, when the spring is maintained in the first state, the male and female cam locking mechanisms are maintained in a locked state and wherein, when the spring is maintained in the second state, the male and female cam locking mechanisms are maintained in an unlocked state.

* * * * *